US012257527B2

(12) United States Patent
Kariuki N.

(10) Patent No.: US 12,257,527 B2
(45) Date of Patent: Mar. 25, 2025

(54) MAGNETIC PLAY DEVICE WITH SIDE FORMS AND THREAD

(71) Applicant: Anthony Dixon Kariuki N., Bellefontaine, OH (US)

(72) Inventor: Anthony Dixon Kariuki N., Bellefontaine, OH (US)

(73) Assignee: Anthony D. Kariuki N., Bellefontaine, OH (US)

( * ) Notice: Subject to any disclaimer, the term of this patent is extended or adjusted under 35 U.S.C. 154(b) by 211 days.

(21) Appl. No.: 17/803,925

(22) Filed: Jan. 24, 2023

(65) Prior Publication Data

US 2024/0246006 A1 Jul. 25, 2024

(51) Int. Cl.
*A63H 33/26* (2006.01)

(52) U.S. Cl.
CPC ..... *A63H 33/26* (2013.01)

(58) Field of Classification Search
CPC ..... A63H 33/26
See application file for complete search history.

(56) References Cited

U.S. PATENT DOCUMENTS

| | | | | | |
|---|---|---|---|---|---|
| 2,199,818 | A * | 5/1940 | Franke | A63J 21/00 | 273/153 R |
| 3,550,316 | A * | 12/1970 | Leonard | A63H 33/26 | 446/133 |
| 3,609,606 | A * | 9/1971 | Podesto | A63H 33/26 | D11/141 |
| 5,052,968 | A * | 10/1991 | Lodrick, Sr. | A63F 9/34 | 446/134 |
| 6,781,270 | B2 * | 8/2004 | Long | H02K 7/06 | 310/152 |
| 10,307,687 | B2 * | 6/2019 | Umberger | A63H 33/26 | |
| 10,617,966 | B1 * | 4/2020 | Pena | A63H 5/00 | |
| 2005/0059317 | A1 * | 3/2005 | McEachen | A63F 9/305 | 446/175 |
| 2024/0050870 | A1 * | 2/2024 | Wellner | A63H 33/26 | |

* cited by examiner

*Primary Examiner* — John A Ricci

(57) ABSTRACT

A magnetic play devise that allows the user the opportunity to discover, experience, explore and experiment with the invisible push and pull forces of magnetic fields in a fun way.

1 Claim, 6 Drawing Sheets

MAGNETIC PLAY DEVICE WITH SIDE FORMS AND THREAD

FIELD OF INVENTION

The present invention is in the field of interactive fidget toys, and in particular relates to providing a hands on experience that is intended to engage the user and challenge him or her to explore, experience and experiment with the dynamics and uniqueness of magnets and magnetism.

BACKGROUND OF THE INVENTION

A fidget toy allows for manipulative play and is typically a small object used for activity with the hands, either manually fidgeting or stimming. Some users believe the fidget toys help them tolerate anxiety, frustration, agitation, boredom, or excitement. The present invention provides a three-dimensional "hands on" activity involving multiple senses, and requiring participation and thinking. Human beings in general have incredible hand eye coordination, incredible sense of touch and complicated proprioceptive systems which is an important sense human beings have that allows them to know where we are in space. Humans crave tactile engagement and fidgeting might be tapping into an unconscious need to train, develop and maintain fine motor skills.

SUMMARY OF THE INVENTION

The play devise is comprised of 2 side form embodiments, which are attached to one another by a length of Thread. The 2 side form embodiments have magnets molded on the inside. The magnets are placed, spaced and molded inside the side form embodiments. The side form embodiments face each other when held out, the length of the Thread. When the side form embodiments are facing each other, the magnets molded inside the side form embodiments have the same polarity facing each other. The user will use both hands when in play. The user will hold one side form embodiment in one hand and hold the other side form embodiment on the other hand. The length of the Thread will determine and limit the distance between the 2 side form embodiments. Thus as the user tries to push the 2 side form embodiments close together and the magnets in the 2 side form embodiments are aligned, the user will experience the side form embodiments repelling each other, because the magnets molded inside the side form embodiments have the same polarity facing each other and are repelling each other. In regards to magnets like poles repel. However, when the user twists the 2 side form embodiments in opposite directions, either clockwise or counter clockwise, the user will either experience the push or pull of the magnets molded inside the side form embodiments, because of the different positions of the magnetic fields of the magnets molded inside the side form embodiments. This allows the user to discover, explore, experience and experiment with the invisible forces of the magnetic fields, created by the magnets molded inside the side form embodiments.

BRIEF DESCRIPTION OF THE DRAWINGS

FIG. 1, magnets 101 are molded inside side form embodiment 100 and magnets 201 are molded inside side form embodiment 200.

FIG. 1, illustrates Thread 102 is of length, and Thread cover 104 and Thread cover 204.

Figure 1:
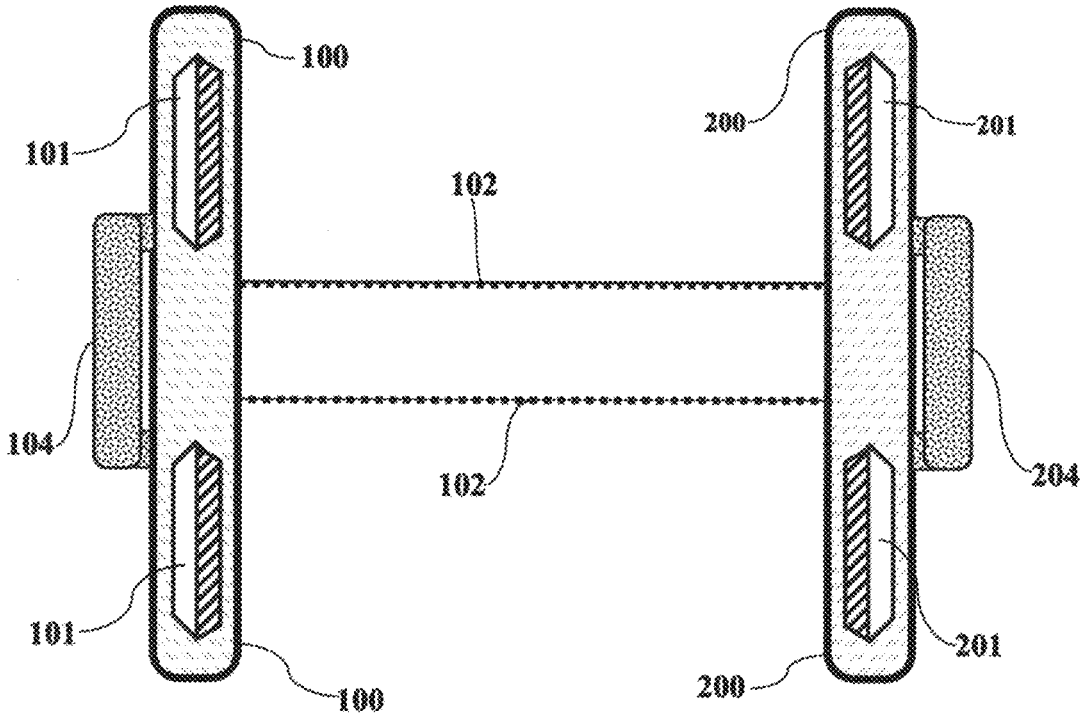
FIG. 1 is the side view representation of the present invention, that illustrates side form embodiment 100 and side form embodiment 200.

Definition of the word FORM: the visible shape or configuration of something.

Magnets 101 represents one or multiple magnets.

Magnets 201 represents one or multiple magnets.

Magnets 101 are placed, spaced and molded inside side form embodiment 100. Magnets 201 are placed, spaced and molded inside side form embodiment 200.

Magnets 101 and magnets 201 used in the play device come in different shapes, dimensions and sizes, depending on the particular design of the play device.

Side form embodiment 100 and side form embodiment 200 are attached together using Thread 102.

Thread cover 104, covers Thread 102 on the outside part of side form embodiment 100 and Thread cover 204 covers Thread 102 on the outside part of side form embodiment 200.

Side form embodiment 100 and side form embodiment 200 come in a variety of shapes, designs, characters, images, sizes, configurations, dimensions, colors and color combinations.

Magnets 101 inside side form embodiment 100 have their magnetic polarity facing the same direction. The Magnets 201 inside side form embodiment 200 have their magnetic polarity facing the same direction.

Figure 2:
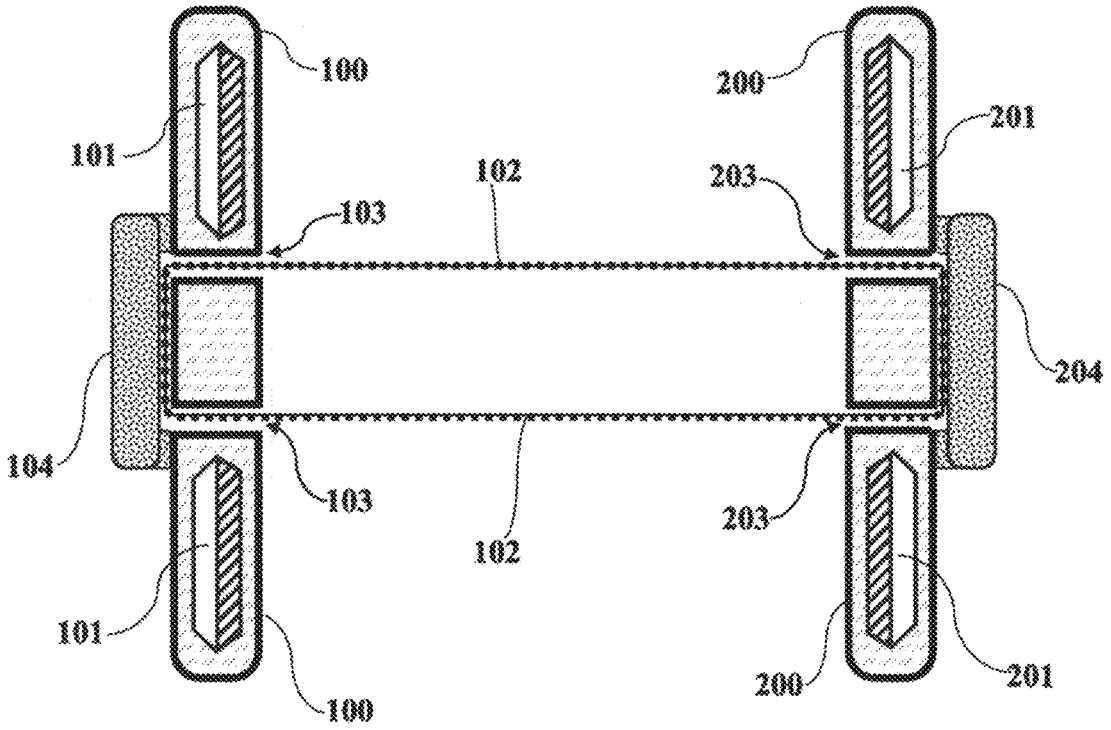

FIG. 2 is the side view representation of side form embodiment 100 with Thread 102 looping in and out through Thread Holes 103, and side form embodiment 200, with Thread 102 looping in and out through Thread holes 203.

Thread 102 is of length and that is what attaches side form embodiment 100 to side form embodiment 200.

Thread 102 is made of strong material.

FIG. 2, Thread holes 103 in side form embodiment 100 are drilled through side form embodiment 100. Thread holes 103 could also be pre-molded onto side form embodiment 100.

FIG. 2, Thread holes 203 in side form embodiment 200 are drilled through side form embodiment 200. Thread holes 203 could also be pre-molded onto side form embodiment 200.

FIG. 2 shows Thread holes 103 representing one or multiples holes drilled or pre-molded onto side form embodiment 100.

FIG. 2 shows Thread holes 203 representing one or multiples holes drilled or pre-molded onto side form embodiment 200.

FIG. 2 also illustrates Thread cover 104 bonded onto side form embodiment 100 and Thread cover 204 bonded onto side form embodiment 200.

FIG. 2, Thread cover 104 can also be pre-molded onto side form embodiment 100, and Thread cover 204 can also be pre-molded onto side form embodiment 200.

FIG. 2, Thread cover 104 protects Thread 102 that has looped through on the outside part of side form embodiment 100 and Thread cover 204 protect Thread 102 that has looped through on the outside part of side form embodiment 200.

Figure 3:
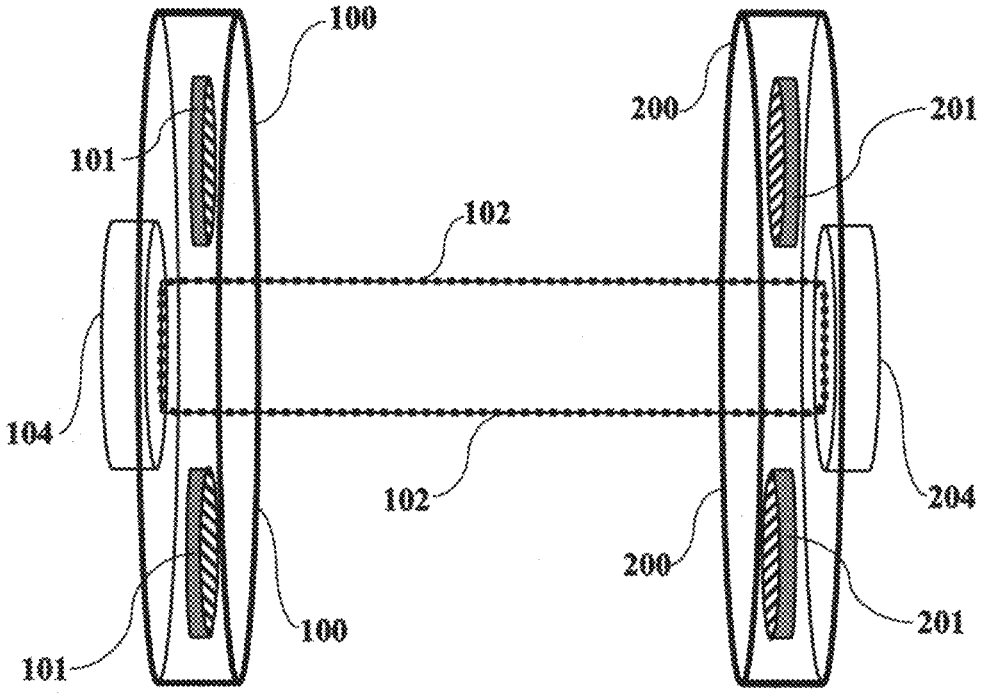

FIG. 3 is the 3-D representation of the present invention, that illustrates side form embodiment 100 and side form embodiment 200.

FIG. 3, magnets 101 molded inside side form embodiment 100 and magnets 201 molded inside side form embodiment 200.

FIG. 3 also illustrates Thread 102, Thread cover 104 and Thread cover 204.

FIG. 1, FIG. 2 and FIG. 3 shows side form embodiment 100 and side form embodiment 200 are attached together using Thread 102. Thread cover 104, covers Thread 102 on the outside part of side form embodiment 100 and Thread cover 204 covers Thread 102 on the outside part of side form embodiment 200.

FIG. 1, FIG. 2 and FIG. 3 shows magnets 101 inside side forms embodiment 100 have their magnetic polarity facing the same direction.

FIG. 1, FIG. 2 and FIG. 3 shows magnets 201 inside side forms embodiment 200 have their magnetic polarity facing the same direction.

Figure 4:
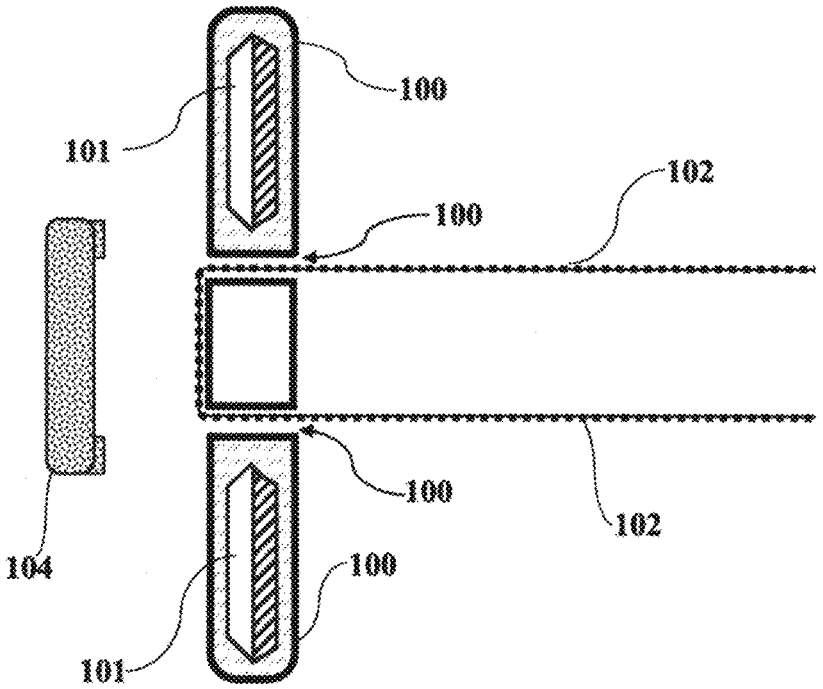

FIG. 4 is the side view of side form embodiment 100 with Thread 102 looping in and out through Thread holes 103 in side form embodiment 100.

FIG. 4 shows Thread holes 103 in side form embodiment 100 drilled onto side form embodiment 100.

FIG. 4 can also illustrate Thread holes 203 in side form embodiment 200 drilled onto side form embodiment 200.

FIG. 4, shows Thread holes 103 can be pre-molded onto side form embodiment 100.

FIG. 4 can also illustrate Thread holes 203 can be pre-molded onto side form embodiment 200.

Figure 5:
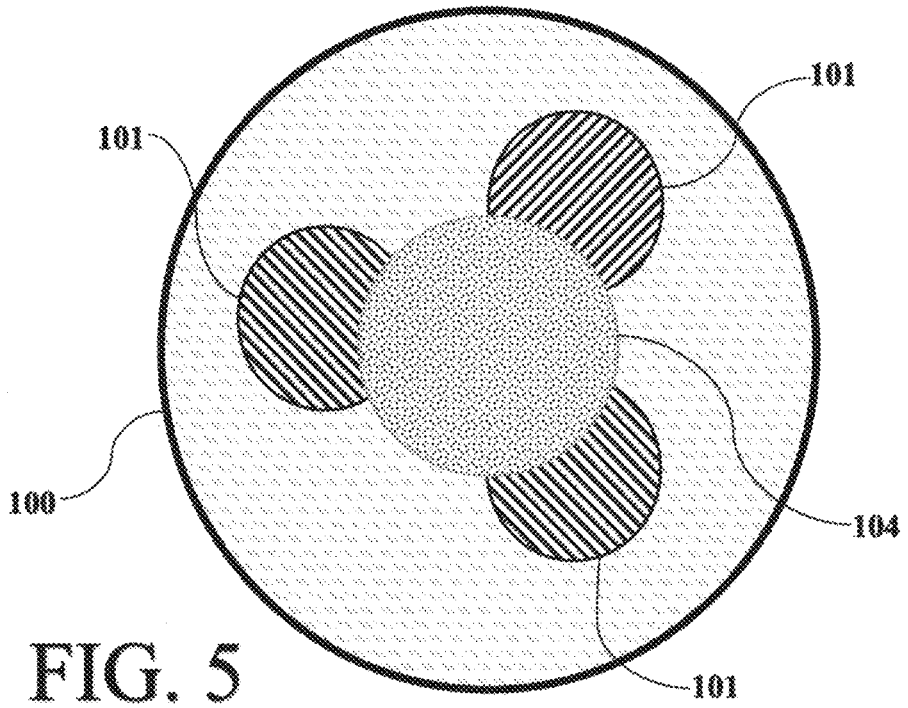

FIG. 5 is the elevation view of side form embodiment 100 and can be used to represent the elevation view of side form embodiment 200. The side form embodiment 100 and side form embodiment 200 come in a variety of shapes, designs, characters, images, sizes, configurations, dimensions, colors and color combinations.

FIG. 5 is the elevation view of magnets 101 that are placed, spaced and molded inside side form embodiment 100.

FIG. 5 can also represent the elevation view of magnets 201 that are placed, spaced and molded inside side form embodiment 200.

FIG. 5 shows Thread cover 104 on side form embodiment 100.

FIG. 5 can also represent Thread cover 204 on side form embodiment 200.

Figure 6:
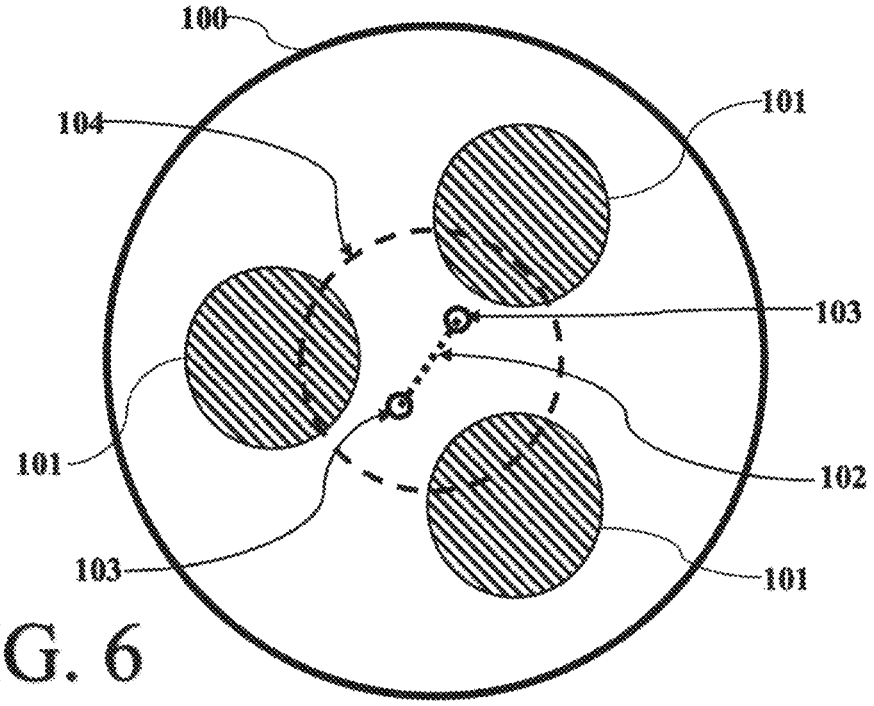

FIG. 6 is the elevation view of side form embodiment 100.

FIG. 6 can also represent the elevation view of side form embodiment 200.

FIG. 6 is the elevation view of magnets 101 placed, spaced and molded inside side form embodiment 100.

FIG. 6 can also represent the elevation view of magnets 201 placed, spaced and molded inside side form embodiment 200.

FIG. 6 is the elevation view of the outline of Thread cover 104 on side form embodiment 100.

FIG. 6 can also represent the elevation view of the outline of Thread cover 204 on side form embodiment 200.

FIG. 6 is the elevation view of Thread holes 103 and how Thread 102 loops in and out from Thread holes 103 on side form embodiment 100.

FIG. 6 can also represent the elevation view of Thread holes 203 and how Thread 102 loops in and out through Thread holes 203 on side form embodiment 200.

Figure 7:
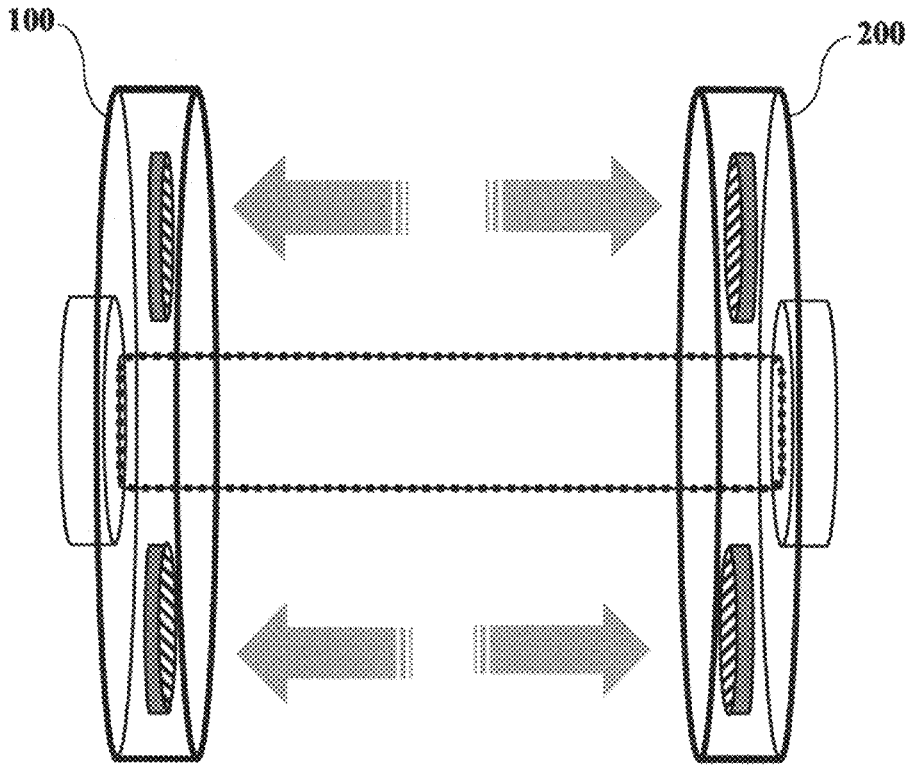

FIG. 7 illustrates side form 100 and side form 200 held out the length of Thread 102

DETAILED DESCRIPTION OF THE INVENTION

Hereinafter, an embodiment will be described in detail with reference to the accompanying drawings.

It will be readily understood that the components of the embodiments are generally described and illustrated in the figures herein. The following more detailed description of the example embodiments, as represented in the figures, is not intended to limit the scope of the embodiments, as claimed, but is merely representative of the example embodiments.

Furthermore, the described features, structures or characteristics, in the description below, will be indicated by the same reference numerals.

With reference to FIG. 1 side view representation, the present invention comprises of side form embodiment 100 and side form embodiment 200, which are made up of a rigid substance.

The side form embodiment 100 and side form embodiment 200 could be made from either molded structures or from a solid material.

The rigid substance of side form embodiment 100 and side form embodiment 200, made from a molded structure was at first a liquid substance that has dried and hardened after it was poured into the mold of side form embodiment 100 and side form embodiment 200. This allows for side form embodiment 100 and side form embodiment 200 to be molded into a variety of shapes, designs, characters, images, sizes, configurations, dimensions, colors and color combinations.

Side form embodiment 100 and side form embodiment 200 that are molded, have magnets 101 molded inside side form embodiment 100 and magnets 201 molded inside side form embodiment 200. The magnets 101 are placed and spaced inside the molds of side form embodiments 100 and the magnets 201 are placed and spaced inside the molds of side form embodiment 200. The liquid substance is then poured into the molds of side form embodiment 100 and side form embodiment 200, and that is how the magnets 101 become a part of side form embodiment 100 and magnets 201 become a part of side form embodiment 200.

The side form embodiment 100 and side form embodiment 200 can also be made from a solid material.

The solid material can be designed in a variety of shapes, designs, characters, images, sizes, configurations and dimensions.

The solid material also comes in a variety of colors and color combinations as well.

The side form embodiments that are made from solid material goes through a different process.

Once the shape and design of side form embodiment 100 and side form embodiment 200 are formed and the position and location of magnets 101 and 201 are determined, hollows are created onto the solid material of side form embodiment 100 and side form embodiment 200 in the shape and size of magnets 101 and magnets 201 that will be used.

Once the hollows have been made, magnets 101 are placed inside the hollows and are bonded or molded into side form embodiment 100, and the magnets 201 are placed inside the hollows and are bonded or molded into side form embodiment 200.

Magnets are generally brittle and can easily chip, shatter, crack or break, when in use, creating a dangerous situation.

Having the magnets molded inside side form embodiment 100 and side form embodiment 200, ensures that the magnets don't chip, shatter, crack or break during use or play.

The magnets 101 inside side form embodiment 100 are placed and spaced inside side form embodiment 100, have their magnetic polarity facing the same direction.

The magnets 201 inside side form embodiment 200 are placed and spaced inside side for embodiment 200, have their magnetic polarity facing the same direction.

The placing and spacing of magnets 101 in side form embodiment 100 can be symmetrical to the placing and spacing of magnets 201 in side form embodiment 200.

The magnetic polarity direction of magnets 101 in side form embodiment 100 is the same as the magnetic polarity direction of magnets 201 in side form embodiment 200, when side form embodiments 100 and side form embodiment 200 are facing each other as illustrated in FIG. 1, FIG. 2 and FIG. 3.

The side form embodiment 100 and side form embodiment 200 are attached to one another with Thread 102 as illustrated in FIG. 1, FIG. 2 and FIG. 3.

The attachment of side form embodiment 100 and side form embodiment 200 by Thread 102, causes side form embodiments 100 and side form embodiment 200 to face each other when they are held out the length of Thread 102 as illustrated in FIG. 1, FIG. 2 and FIG. 3.

The attachment by Thread 102 of side form embodiment 100 and side form embodiment 200, causes magnets 101 and magnets 201 inside side form embodiments 100 and side form embodiment 200, to have the same magnetic polarity direction when facing each other as illustrated in FIG. 1, FIG. 2 and FIG. 3.

The attachment by Thread 102 of side form embodiment 100 to side form embodiment 200, allows side form embodiments 100 and side form embodiment 200 to be flexible and move freely within the range of the length of Thread 102.

The magnetic field of magnets 101 inside form embodiment 100 and the magnetic fields of magnets 201 inside form embodiment 200 when facing each other have the same polarity. Thus when the user tries to bring side form embodiments 100 and side form embodiment 200 close together, and in the event magnets 101 inside side form embodiment 100 are aligned to magnets 201 inside side form embodiment 200, the user will experience the push effect of magnets 101 against magnets 201 as they are repelling each other. Like poles of 2 magnets repel each other.

As the user begins to twist side form embodiment 100 and side form embodiment 200 in opposite direction, depending on the positioning of magnets 101 and magnets 201, the user will experience either the push effect or the pull effect of magnets 101 and magnets 201 inside side form embodiments 100 and side form embodiment 200.

The attachment by Thread 102 of side form embodiments 100 to side form embodiment 200 causes the play devise to be one unit.

The present invention requires the full assembly of both side form embodiment 100 and side form embodiment 200 to function.

Thread 102 is made of strong material.

Thread 102 can either be a single Thread or multiple Threads, depending on the design.

Thread 102 comes in a variety of thread thickness. The design of the play devise will determine the size of the thickness of Thread 102, that will be implemented.

Thread 102 comes in a variety of colors and color combinations. The design of the play devise will determine the color and/or color combinations of Thread 102 that will be implemented.

Thread 102 can be attached to side form embodiment 100 and side form embodiment 200 by molding Thread 102 inside side form embodiment 100 and side form embodiment 200.

Thread 102 can also be attached to side form embodiment 100 by drilling or pre-molding Thread holes 103 on side form embodiment 100.

Thread 102 can also be attached to side form embodiment 200 by drilling or pre-molding Thread holes 203 through side form embodiment 200.

The side form embodiment 100 and side form embodiment 200 are connected using Thread 102 that loops through Thread holes 103 on side form embodiment 100 and Thread 102 that loops through Thread holes 203 on side form embodiment 200.

FIG. 2 illustrates Thread holes 103 and Thread holes 203, that have been drilled or pre-molded through side form embodiment 100 and side form embodiment 200. Thread 102 is then threaded through Thread holes 103 and Thread holes 203, to attach side form embodiments 100 to side form embodiment 200, as illustrated in FIG. 1, FIG. 2 and FIG. 3.

FIG. 6 illustrates the elevation view of how Thread 102 loops through Thread holes 103 that are either drilled through or pre-molded onto side form embodiment 100.

FIG. 6 can also be used to illustrate the elevation view of how Thread 102 loops through Thread holes 203 that are either drilled through or pre-molded onto side form embodiment 200.

Thread 102 that is looping through side form embodiment 100 is covered by Thread cover 104.

Thread 102 that is looping Through side form embodiment 200 is covered by Thread cover 204.

Thread cover 104 is bonded onto side form embodiment 100 to protect Thread 102 that is looping through side form embodiment 100.

Thread cover 104 that is bonded onto side form embodiment 100 is made of a strong material and comes in a variety of shapes, designs, characters, images, sizes, configurations, dimensions, colors and color combinations, which can be incorporated in the design process together with side form embodiment 100.

Thread cover 204 is bonded onto side form embodiment 200 to protect Thread 102 that is looping through side form embodiment 200.

Thread cover 204 that is bonded onto side form embodiment 200 is made of a strong material and comes in a variety of shapes, designs, characters, images, sizes, configurations, dimensions, colors and color combinations, which can be incorporated in the design process together with side form embodiment 200.

Thread cover 104 can also be molded onto side form embodiment 100 to protect Thread 102 that is looping through side form embodiment 100.

Thread cover 104 that is molded onto side form embodiment 100 is made of a strong material and comes in a variety of shapes, designs, characters, images, sizes, configurations, dimensions, colors and color combinations, which can be incorporated in the design process together with side form embodiment 100.

Thread cover 204 can also be molded onto side form embodiment 200 to protect Thread 102 that is looping through side form embodiment 200.

Thread cover 204 that is molded onto side form embodiment 200 is made of a strong material and comes in a variety of shapes, designs, characters, images, sizes, configurations, dimensions, colors and color combinations, which can be incorporated in the design process together with side form embodiment 200.

Thus, there has been provided, in accordance with the present invention of a play device which fully satisfies the goals, objects and advantages set forth herein. Therefore, having described specific embodiments of the present invention, it will be understood that alternatives, modifications and variations thereof may be suggested to those skilled in the art, and that it is intended that the present specification embrace all such alternatives, modifications and variation as falls within the scope of the claims.

What is claimed is:

1. A play device, which comprises:

a first side form assembly, which includes a first planar side form, a first plurality of magnets received and fixed within the first side form in planar relation, a plurality of thread holes through the first side form, and a first thread cover;

a second side form assembly, of similar size and shape as the first side form assembly, which includes a second planar side form, a second plurality of magnets received and fixed within the second side form in planar relation, a plurality of thread holes through the second side form, and a second thread cover;

a loop of thread which extends through the thread holes of the first side form and the second side form, ends of which are covered by the first thread cover and second thread cover, the thread flexibly connects the first side form assembly and the second side form assembly along a first axis;

each magnet of the first side form assembly having a polarity, and each magnet arranged with a same first polarity relative to the first axis;

each magnet of the second side form assembly having a polarity, and each magnet arranged with a same second polarity relative to the first axis, this second polarity being opposite to the first polarity;

the first and second side form assemblies arranged so that a user may grasp each side form assembly and move and twist each along the thread to different positions, to experience varying effects of magnetic fields of the first plurality of magnets relative to the second plurality of magnets.

* * * * *